United States Patent [19]

Hanyu et al.

[11] Patent Number: 4,781,133

[45] Date of Patent: Nov. 1, 1988

[54] AUTOMATIC BUTTONHOLE STITCHING METHOD OF SEWING MACHINE

[75] Inventors: Susumu Hanyu, Hachioji; Toshiaki Kume, Tachikawa; Hachiro Makabe, Fussa, all of Japan

[73] Assignee: Janome Sewing Machine Co. Ltd., Tokyo, Japan

[21] Appl. No.: 84,804

[22] Filed: Oct. 15, 1979

[30] Foreign Application Priority Data

Oct. 24, 1978 [JP] Japan ..... 54-130798

[51] Int. Cl.[4] ..... D05B 97/00

[52] U.S. Cl. ..... 112/264.1

[58] Field of Search ..... 112/264.1; 65, 66, 70, 112/158 B

[56] References Cited

U.S. PATENT DOCUMENTS

| | | | |
|---|---|---|---|
| 273,727 | 3/1883 | Hallenbeck | 112/264.1 X |
| 389,840 | 9/1888 | Fletcher | 112/264.1 |
| 3,570,433 | 3/1971 | Weisz | 112/264.1 |
| 4,159,688 | 7/1979 | Garron et al. | 112/264.1 |
| 4,215,640 | 8/1980 | Coughenour | 112/264.1 |

*Primary Examiner*—H. Hampton Hunter

*Attorney, Agent, or Firm*—Michael J. Striker

[57] ABSTRACT

A method for automatically stitching by a zigzag sewing machine a button hole, which includes two line-tack stitching parts stitched sequentially, comprises applying a predetermined amount of fabric feeding to a first group of alternate stitches in both line-tack stitching parts, and then applying no fabric feeding to a second group of alternate stitches in the line-tack stitching parts by not moving the fabric relative to the needle in any direction. Inclined stitches and non-inclined stitches which alternate with each other result in each line-tack stitching part.

2 Claims, 1 Drawing Sheet

AUTOMATIC BUTTONHOLE STITCHING METHOD OF SEWING MACHINE

BRIEF DESCRIPTION OF THE INVENTION

This invention relates to a method of an automatic buttonhole stitching by a sewing machine, improving the precision of buttonhole stitching length, and at the same time providing the balanced stitches of buttonhole especially when the buttonhole is stitched by a sewing machine in which a horizontal loop taker is employed.

The conventional automatic buttonhole stitching systems are generally a sensor system and an automatic cycle system, the former sensing the respective parts of buttonhole stitches, for example, the bar-tack and line-tack stitching parts, from the fabric feeding amount by means of a sensor mounted on the presser foot, and the latter predetermining the number of stitches for the respective stitching parts of a buttonhole. Each of these systems forms the buttonhole stitches in a condition that a predetermined small amount of fabric feeding is applied to each stitch of the buttonhole.

According to the sensor system, it is supposed that a buttonhole of a predetermined length is produced, even if there is a mechanical error in the feeding amount. However, with additional error in the sensor, there may actually be errors of about ±1 to 1.5 mm in the buttonhole of a length of about 20 mm.

On the other hand, in the automatic cycle system, if there is a mechanical error in the feeding amount, the error is accumulated in the total length of buttonhole in proportion to the number of stitches. It is, therefore, necessary to maintain a precision in each stitch of the buttonhole. For example, in order to produce a buttonhole of about 20 mm in length, and of 50 stitches in each line tack stitching part, and in order to finish up the buttonhole with the errors at most within ±1 to 1.5 mm in the total length, the permissible error must be maintained within ±0.02 to 0.03 mm per stitch in the line tack stitching parts.

The present invention has been devised to eliminate such defects and disadvantages of the prior art. It is a primary object of the invention to provide an improvement in stitching a buttonhole, thereby to remarkably heighten the precision of the buttonhole length. That is, this improvement is to apply a predetermined feeding amount to the alternate stitches in the line-tack stitching parts of buttonhole while applying no feeding to the other alternative stitches.

It is another object of the invention to predetermine the alternative stitches which are to apply no feeding, so as to heighten the effect of outer appearance of buttonhole.

The other features and advantages of the invention will be apparent from the following description of the invention in reference to the preferred embodiment as shown in the attached drawing.

DETAILED DESCRIPTION OF THE INVENTION

Figure 1:
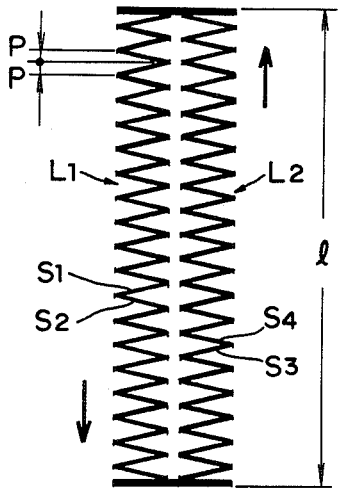
FIG. 1 is an explanatory view of buttonhole stitches produced by the conventional manner.
Figure 2:
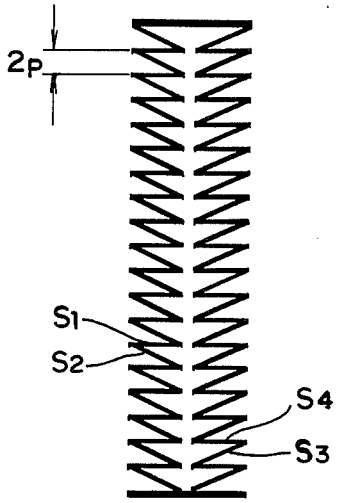
FIGS. 2 to 4 are explanatory views of buttonhole stitches produced by the present invention.
Figure 3:
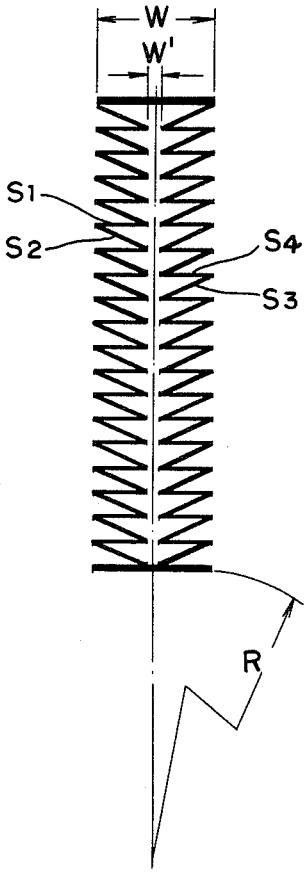
Figure 4:
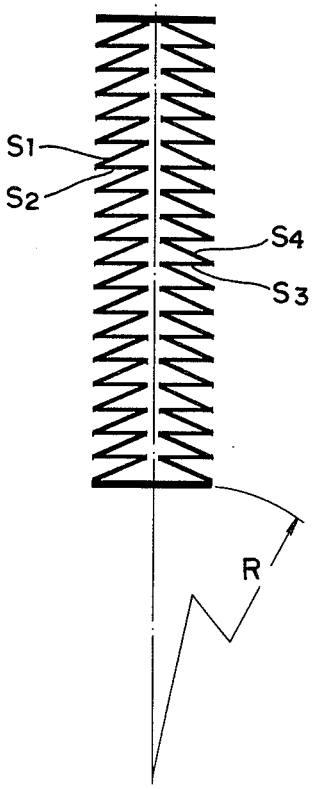

The present invention will be explained in reference to the attached drawing. In FIGS. 1 to 4, a reference letter "l", shows a length of a buttonhole, "W" is a width, "W'" is a cutting space, "$L_1$" is a left side line tack stitches, and "$L_2$" is a right side line tack stitches. "$s_1$" and "$s_2$" are outwardly and inwardly directed stitches each repeated in the left side line tack stitches $L_1$, and "$s_3$" and "$s_4$" are outwardly and inwardly directed stitches each repeated in the right side line tack stitches $L_2$. FIG. 1 shows a buttonhole of conventional stitches produced by a zig-zag sewing machine where the needle bar swings in a vertical flat plane intersecting the horizontal needle plate. FIG. 2 is an example of a buttonhole in accordance with the present invention produced by the said zig-zag sewing machine. FIGS. 3 and 4 are other examples of buttonholes in accordance with the present invention produced by a sewing machine where a horizontal loop taker is employed and therefor the needle bar swings in a circular arc of radius R in a vertical plane intersecting the horizontal needle plate.

In the line tack stitches shown in FIG. 1, the fabric feeding amount P is applied per each stitch in such a manner that any vertical lines connecting the two needle dropping points could form isosceles triangles (referred to as "triangle wave stitches"). In FIG. 2, the stitches with and without feeding amount 2P are alternately formed (referred to as "saw-type stitches"). The two buttonholes in FIGS. 1 and 2 are the equal length "l" with the same number of stitches. Actually, since the line tack stitches of buttonhole are more in zig-zag stitches, the said saw-type stitches will not detract the outer appearance of the buttonhole. It is to be generally noted that the feeding error, which is caused in the mechanical course from the fabric feed adjuster to the feed dog until the needle penetrates the fabric, is hardly changed whether the determined value of the fabric feeding amount is P or 2P. In other words, the feeding error is less by a half in the feeding amount 2P than the feeding amount P. In FIG. 2, it is free to determine which stitches $s_1$ or $s_2$ and $s_3$ or $s_4$ should be of non-feeding. In the conventional buttonhole shown in FIG. 1, even if the needle drops on the isoseceles triangle due to the so-called hitch stitch generally on the left side points of the zig-zag stitches the observed stitches show alternately unbalanced inclinations to be more or less saw-type stitches. It is, therefore, possible to modify the stitches in FIG. 2 by applying non-feeding to the stitches of strong inclination.

A next reference will be made to a case of the sewing machine in which a horizontal loop taker is employed. FIGS. 3 and 4 show comparisons of the saw-type stitches in the line tack stitching part of a buttonhole produced by the sewing machine of the type in which a center of the horizontal loop taker is located nearer to the machine operator than the needle dropping position. In FIG. 3 the stitches $s_1$ and $s_4$ are of non-feeding. On the other hand, in FIG. 4 the stitches $s_2$ and $s_3$ are of nonfeeding. It can be said that the stitches in FIG. 3 appear more balanced and more natural.

In the second embodiment of this invention especially in FIG. 3 produced by the above mentioned type of sewing machine the stitches $s_1$ and $s_4$ is accompanied by the observed feeding, though the fabric is not actually fed. Therefore, these stitches are selected as of the non-feeding and the other stitches are actually accompanied by a feeding of the amount twice as much as the conventional feeding amount of the buttonhole stitches, so as to improve the precision of the buttonhole length.

We claim:

1. A method for automatically stitching a buttonhole by means of a zigzag sewing machine, having a needle, the buttonhole including at lesat two line-tack stitching parts which are to be sequentially stitched, the method comprising a step of applying a predetermined amount of fabric feeding to a first group of alternate stitches in said line-tack stitching parts, and a step of applying no fabric feeding to a second group of alternate stitches in the same line-tack stitching parts so that no movement is applied to the fabric relative to the needle in any direction during stitching of said second group of alternate stitches, whereby inclined stitches and non-inclined stitches are formed alternatively in each line-tack stitching part.

2. A method for automatically stitching a buttonhole by means of a zigzag sewing machine having a horizontal loop taker and a needle, the buttonhole including at least two line-tack stitching parts which are to be sequentially stitched, the method comprising a step of applying no fabric feeding to a predetermined group of alternate stitches in said line-tack stitching parts so that no movement is applied to the fabric relative to the needle in any direction during stitching said predetermined group of alternate stitches and a step of applying a predetermined amount of fabric feeding to the other group of alternate stitches in the same line-tack stitching parts whereby inclined stitches and non-inclined stitches are formed alternatively in each line-tack stitching part.

* * * * *